US006618911B1

(12) United States Patent
Chung

(10) Patent No.: US 6,618,911 B1
(45) Date of Patent: Sep. 16, 2003

(54) BOTTOM OPEN-END TYPE INVISIBLE ZIPPER WITH A MOVABLE BOTTOM-END PIECE

(76) Inventor: Roger C. Y. Chung, 2F, No. 1, Alley 3, Lane 106, Lung-An Rd., Hsinchung City, Taipei Hsien (TW)

( * ) Notice: Subject to any disclaimer, the term of this patent is extended or adjusted under 35 U.S.C. 154(b) by 0 days.

(21) Appl. No.: 09/722,289

(22) Filed: Nov. 28, 2000

(51) Int. Cl.[7] ..... A44B 19/38
(52) U.S. Cl. ..... 24/433; 24/432; 24/434
(58) Field of Search ..... 24/432, 433, 435, 24/437, 426, 441, 642, 387–389, 430, 418, 419, 429; A44B 19/38

(56) References Cited

U.S. PATENT DOCUMENTS

| | | | | | |
|---|---|---|---|---|---|
| 3,805,339 | A | * | 4/1974 | Howell | 24/205.11 |
| 5,131,120 | A | * | 7/1992 | Akashi | 24/433 |
| 5,697,130 | A | * | 12/1997 | Smith | 24/383 |
| 6,112,376 | A | * | 9/2000 | Akashi et al. | 24/433 |

FOREIGN PATENT DOCUMENTS

| | | | | | |
|---|---|---|---|---|---|
| CA | 541221 | | * | 5/1957 | 24/205.11 |
| EP | 0581319 | A2 | * | 2/1994 | 24/433 |
| FR | 0715691 | | * | 12/1931 | 24/205 |
| FR | 0979360 | | * | 4/1951 | 24/205.11 |

* cited by examiner

*Primary Examiner*—William L. Miller
*Assistant Examiner*—André L. Jackson
(74) *Attorney, Agent, or Firm*—Bacon & Thomas, PLLC

(57) ABSTRACT

A bottom open-end type invisible zipper. The zipper includes a first zipper tape and a second zipper tape. The zipper tapes each having a respective series of teeth longitudinally disposed at an inner side for interlocking. A first plug member a second plug member are respectively fixedly fastened to the zipper tapes and longitudinally connected to one end of the series of teeth at the respective zipper tape. A movable bottom-end piece slidably is coupled to the first zipper tape, and the movable bottom-end piece includes a receiving chamber adapted to receive the first plug member and the second plug member in parallel. An escape-preventive structure is adapted to stop the movable bottom-end piece from falling out of the first zipper tape.

4 Claims, 18 Drawing Sheets

BOTTOM OPEN-END TYPE INVISIBLE ZIPPER WITH A MOVABLE BOTTOM-END PIECE

BACKGROUND OF THE INVENTION (a) Field of the Invention

The present invention relates to invisible zipper and, more particularly, to a bottom open-end type invisible zipper, which has movable bottom-end piece that can be moved away from the stitching area when using a sewing machine to stitch the zipper to an object.

(b) Description of the Prior Art

A regular bottom open-end type invisible zipper (see FIG. 1) is generally comprised of two zipper tapes 10, two series of teeth 20, two plug members 30, and a bottom-end piece 40. The two series of teeth 20 and the two plug members 30 are respectively fixedly fastened to the zipper tapes 10. The bottom-end piece 40 is fixedly fastened to one plug member 30. This structure of bottom open-end type invisible zipper is suitable for use to close/open an opening in a dress, jacket, etc. When closing, the other plug member is inserted into the bottom-end piece 40, and then the slide is pulled upwards to interlock the two series of teeth. However, because the dimension of the bottom-end piece 40 is much greater than the cross section of the series of teeth 20, the presser foot 100 of the sewing machine cannot pass over the bottom-end piece when fastening the zipper tapes 10 to a dress or the like (see FIG. 2). In order to eliminate the aforesaid problem, an invisible zipper with detachable bottom-end piece is disclosed. According to this design, one plug member 30 is constructed having a split hook 301, and the bottom-end piece 40 is made having hooked portions 402 disposed in one insertion hole 401 for engagement with the split hook 301 after insertion of the plug member 30 into the insertion hole 401. The bottom-end piece 40 is separated from the corresponding plug member 30 before fastening the zipper tapes 10 to the dress or the like. After installation of the invisible zipper, the bottom-end piece 40 is secured to the split hook 301 of the plug member 30. Because the plug member 30 and the bottom-end piece 40 are small elements, it is complicated to form the designed split hook 301 on the plug member 30 and the designed hooked portions 402 in the bottom-end piece 40. Any small error during die-casting or injection molding procedure causes a defective product. Further, because the bottom-end piece 40 is kept separated from the invisible zipper when selling, it tends to be missed.

SUMMARY OF THE INVENTION

The present invention has been accomplished under the circumstances in view. It is the main object of the present invention to provide a bottom open-end type invisible zipper, which has a movable bottom-end piece that does not hinder the stitching operation to fasten the invisible zipper to an object. According to one aspect of the present invention, the bottom open-end type invisible zipper comprises a first zipper tape and a second zipper tape, the zipper tapes each having a respective series of teeth longitudinally disposed at an inner side for interlocking; a first plug member and a second plug member respectively fixedly fastened to the zipper tapes and longitudinally connected to one end of the series of teeth at the respective zipper tape; a movable bottom-end piece slidably coupled to the first zipper tape, the movable bottom-end piece having a receiving chamber adapted to receive the first plug member and the second plug member in parallel; and an escape-preventive structure adapted to stop the movable bottom-end piece from falling out of the first zipper tape, the escape-preventive structure including a male locating means fixedly disposed at the first plug member and a female locating means fixedly disposed at the second plug member for engagement with the male locating means to stop the movable bottom-end piece at the first plug member. According to another aspect of the present invention, the first plug member with the first zipper tape and the second plug member with the second zipper tape can be selectively arranged at either side to fit the left-handed user or the right-handed user.

DETAILED DESCRIPTION OF THE PREFERRED EMBODIMENT

Figure 1:
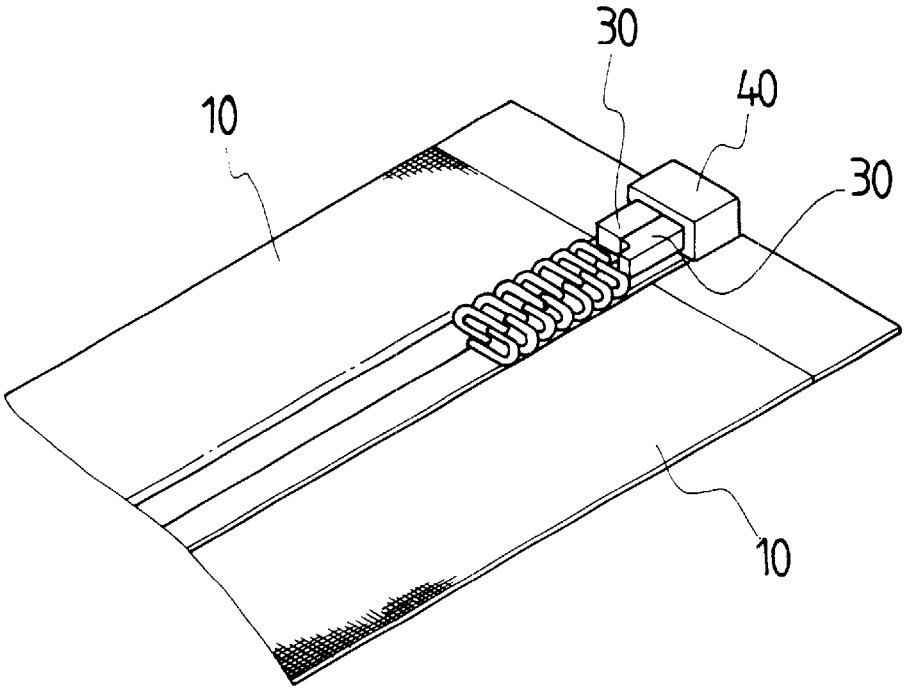
FIG. 1 PRIOR ART
FIG. 1 is a perspective view of a bottom open-end type invisible zipper according to the prior art.
Figure 2:
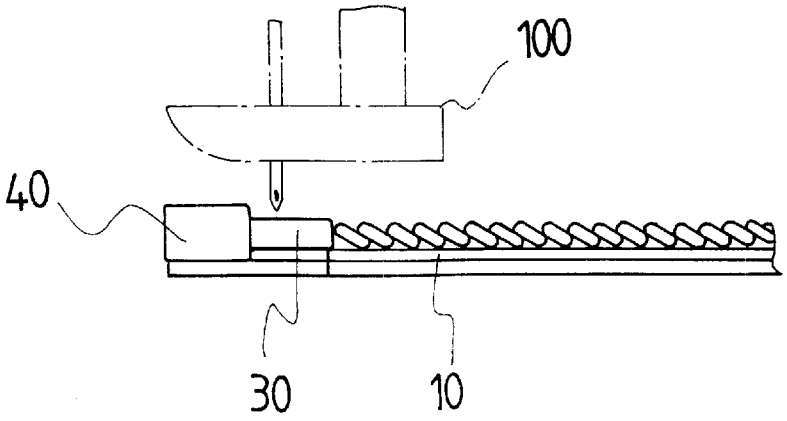
FIG. 2 PRIOR ART
FIG. 2 is a schematic drawing showing the obstruction of the bottom-end piece of the prior art bottom open-end type invisible zipper in the way of the presser foot.
Figure 3:
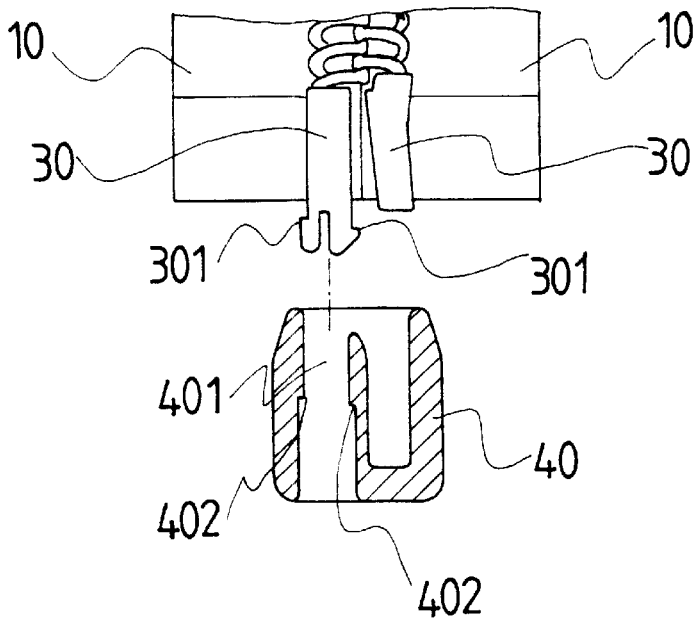
FIG. 3 PRIOR ART
FIG. 3 is an exploded view in section of another structure of bottom open-end type invisible zipper according to the prior art.
Figure 4:
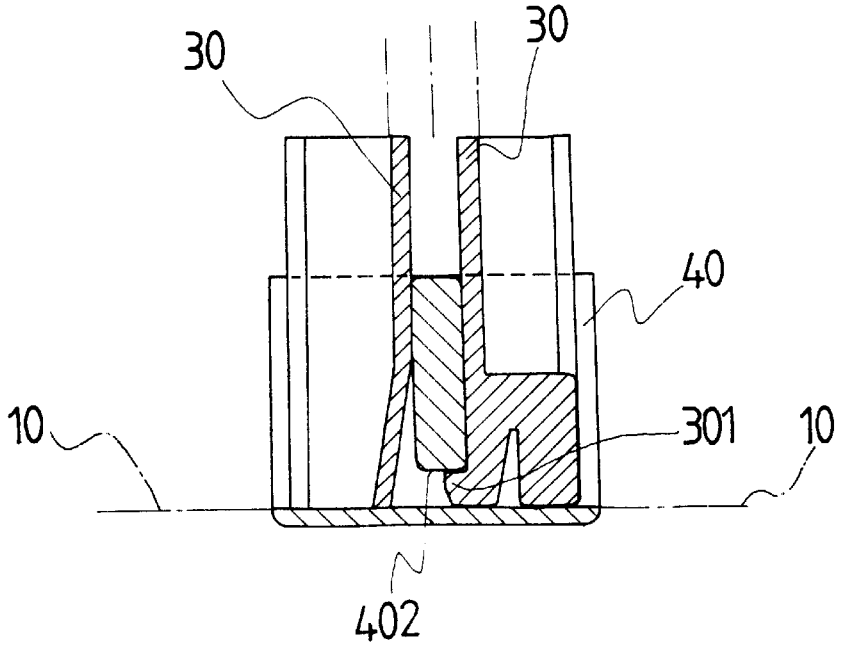
FIG. 4 PRIOR ART
FIG. 4 is a sectional view of a bottom open-end type invisible zipper according to the prior art.
Figure 5:
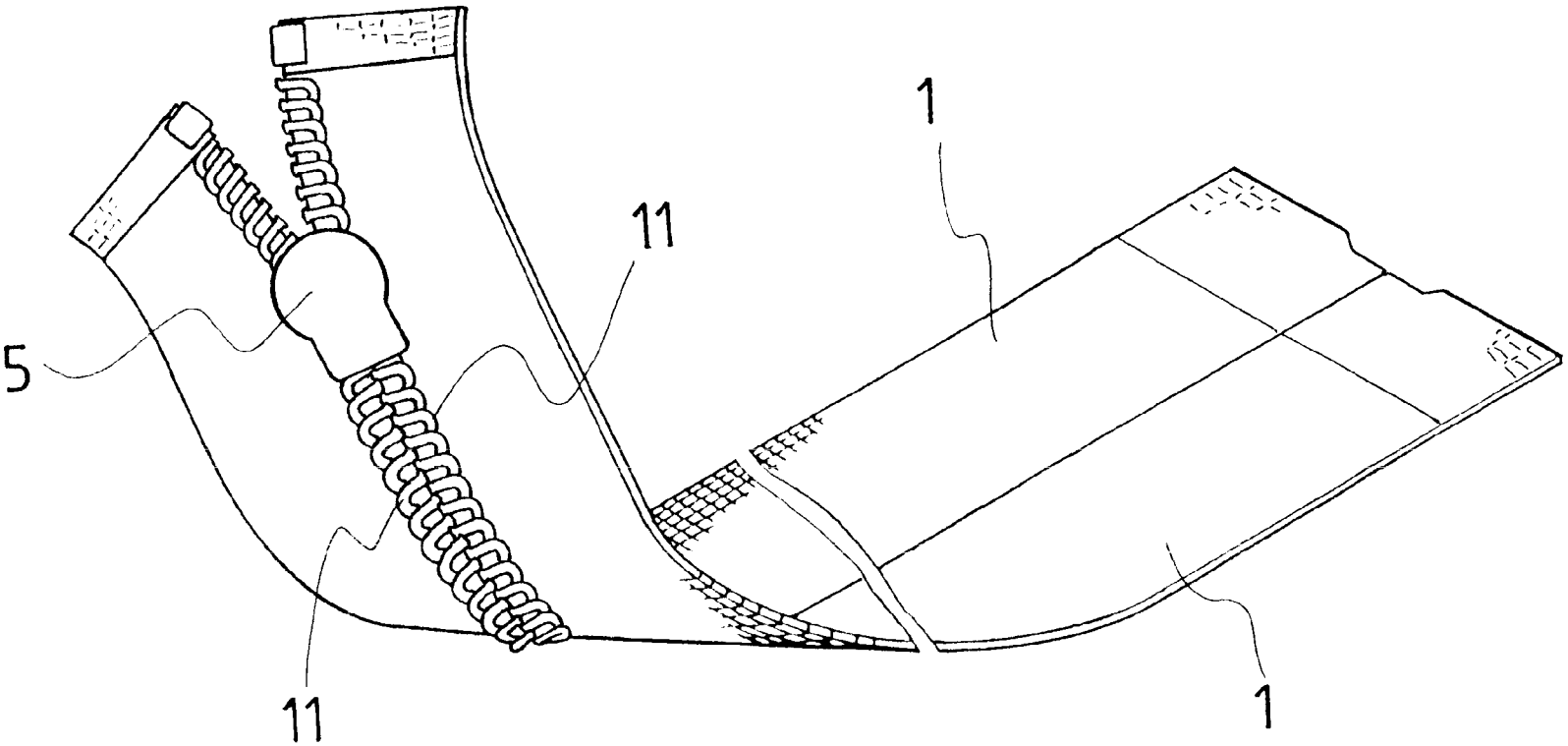
FIG. 5 is a perspective view of a bottom open-end type invisible zipper according to the present invention.
Figure 6:
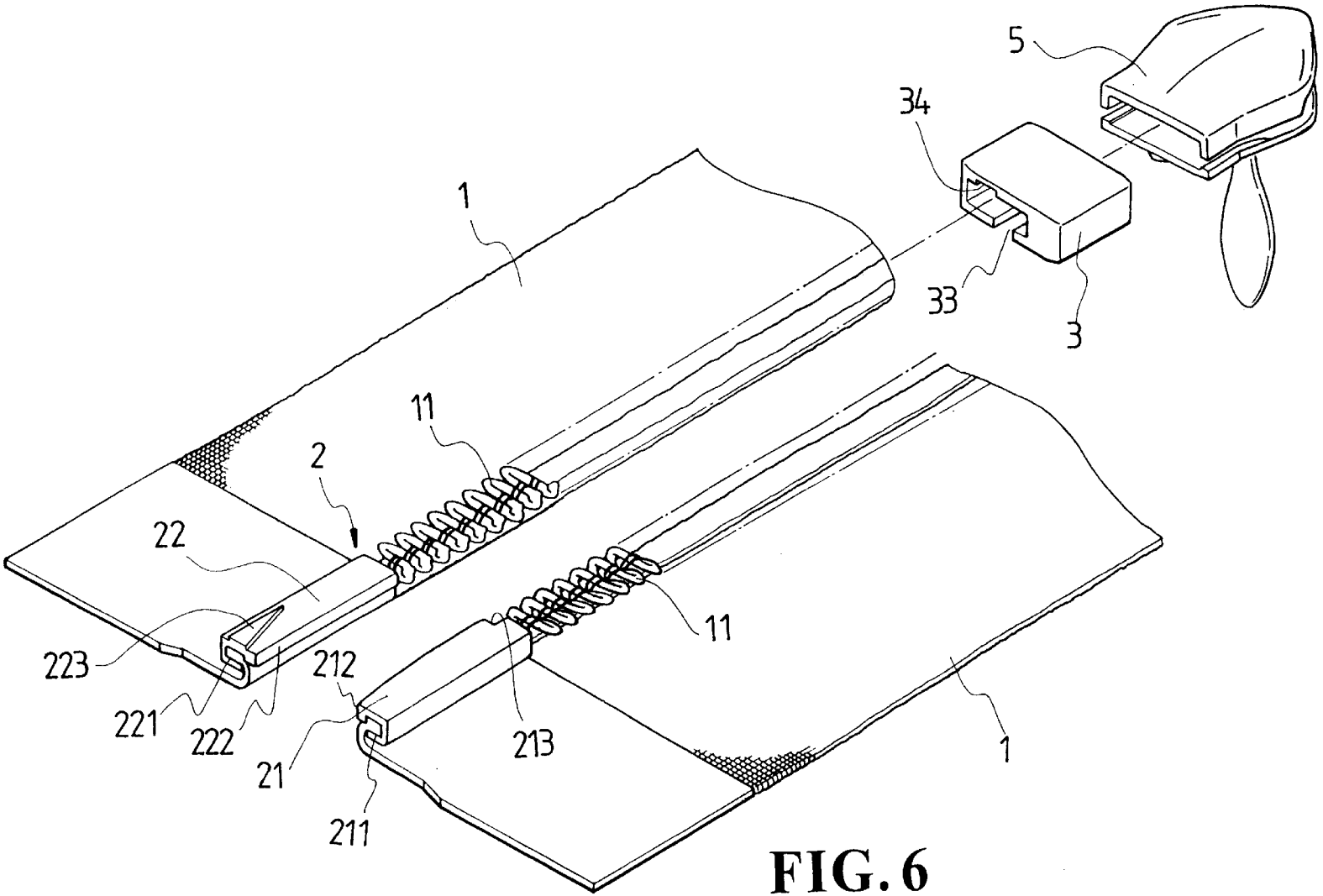
FIG. 6 is an exploded, oblique back side view of the present invention.

Referring to FIGS. 5 and 6, a bottom open-end type invisible zipper in accordance with the present invention is shown comprised of two zipper tapes 1, a plug member set 2, a movable bottom-end piece 3, an escape-preventive structure, and a slide 5.

The zipper tapes 1 each have a series of teeth 11 longitudinally arranged at one side. The teeth 11 of each zipper tape 1 can be independent metal teeth respectively fastened to the fabric body of the respective zipper tape. Alternatively, the teeth 11 of each zipper tape 1 can be a continuous series of loop directly molded from resin on the fabric body of the respective zipper tape. The teeth 11 each have a protruding upper face for interlocking. Each zipper tape 1 has a peripheral flap that keeps the respective series of teeth 11 from sight.

The plug member set 2 (see FIG. 6) includes a male plug member 21 and a female plug member 22. The male plug member 21 and the female plug member 22 can be made of metal by die casting or stamping, and then respectively fixedly fastened to the zipper tapes 1 at one end of the respective series of teeth 11. Alternatively, the male plug member 21 and the female plug member 22 can be injection-molded from plastics on the respective zipper tapes 1. The male plug member 21 comprises a longitudinal coupling groove 211, a protruding flange 212 downwardly extended from the top sidewall thereof and longitudinally disposed at an outer side of the longitudinal coupling groove 211, and an end notch 213 at the top end thereof. The female plug member 22 comprises a longitudinal coupling groove 221, and a protruding flange 222 downwardly extended from the top sidewall thereof and longitudinally disposed at an outer side of the longitudinal coupling groove 221. When the male plug member 21 and the female plug member 22 are attached together, the tail end of the series of teeth 11 in front of the female plug member 22 is engaged into the end notch 213 of the male plug member 21.

The movable bottom-end piece 3 (see FIGS. from 8 through 11) is shaped like a rectangular case comprising a receiving chamber 31 extended through front and rear sides thereof and adapted to receive the male plug member 21 and the female plug member 22, a vertical rear stop wall 32 disposed at the rear side of the receiving chamber 31 and adapted to stop the male plug member 21, a top slot 33 longitudinally cut through the top sidewall thereof. The top slot 33 has a relatively wider front half and a relatively narrower rear half.

Figure 7:
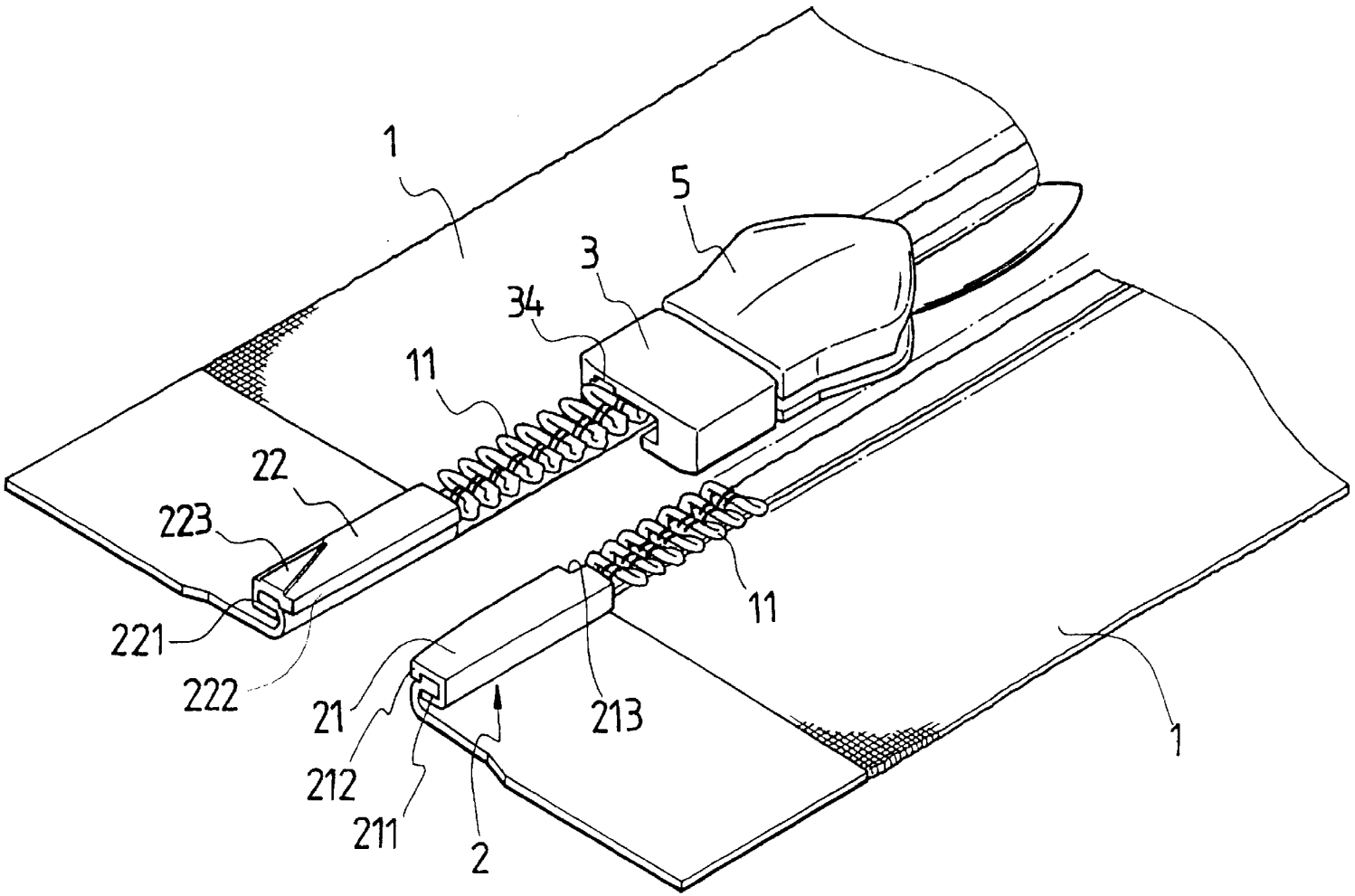
FIG. 7 is an oblique back side view of the present invention.
Figure 8:
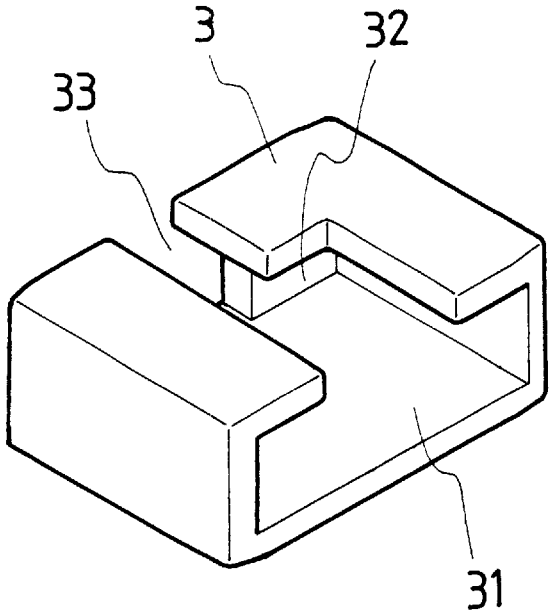
FIG. 8 is a perspective view of the movable bottom-end piece according to the present invention.
Figure 9:
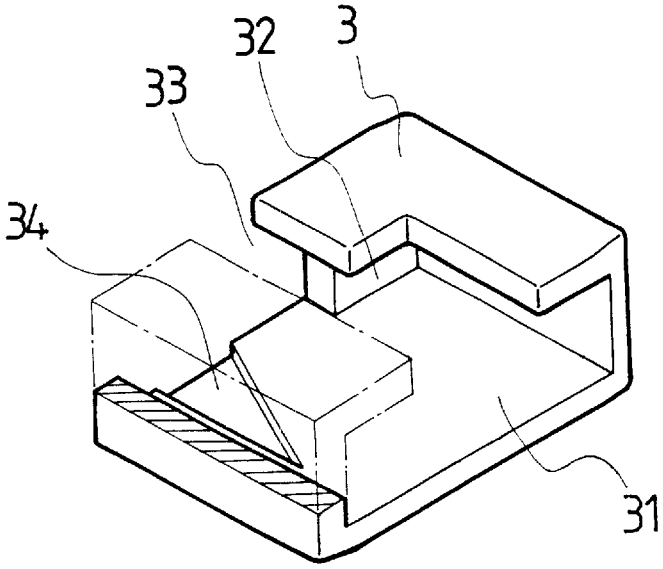
FIG. 9 is a sectional elevation of the movable bottom-end piece according to the present invention.
Figure 10:
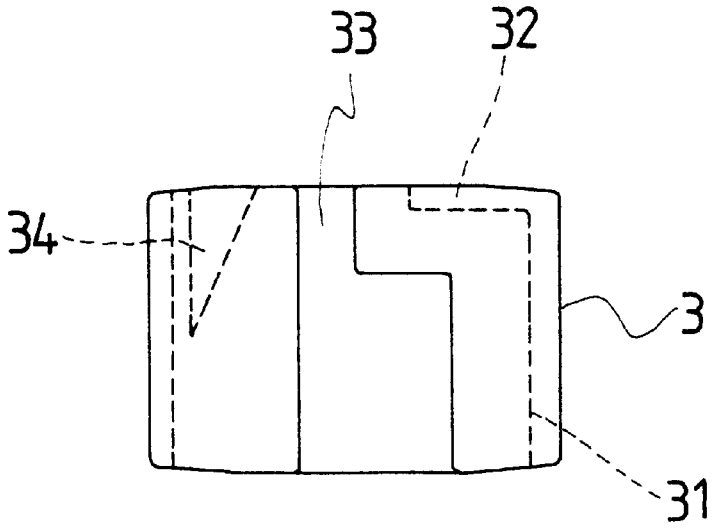
FIG. 10 is a top plain view of the movable bottom-end piece according to the present invention.
Figure 11:
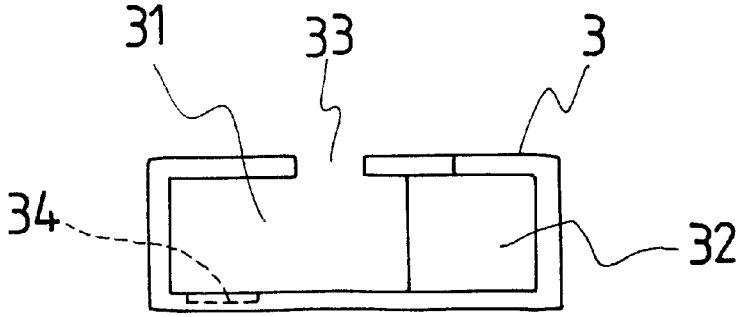
FIG. 11 is a front side view of the movable bottom-end piece according to the present invention.

The aforesaid escape-preventive structure (see FIGS. 7 and 9) comprises a locating block 223 formed integral with the top surface of the top sidewall of the female plug member 22, and a locating groove 34 formed on the inside wall of the movable bottom-end piece 3 and adapted to receive the locating block 223. The locating groove 34 can have a triangular, wedge-like, or rectangular shape. The shape of the locating block 223 fits the locating groove 34. When moving the movable bottom-end piece 3 along the series of teeth 11 on one zipper tape 1 to the bottom limit position, the locating groove 34 is forced into engagement with the locating block 223, and therefore the movable bottom-end piece 3 is stopped from escaping out of the zipper tape in which the female plug member 22 is installed. Further, the engagement between the locating groove 34 and the locating block 223 keeps the female plug member 22 positively positioned in the receiving chamber 31 of the movable bottom-end piece 3.

The assembly process of the present invention is outlined hereinafter with reference to FIGS. from 5 through 7. The male plug member 21 and the female plug member 22 are respectively fixedly fastened to the zipper tapes 1 at the rear end of the respective inner side, and the series of teeth 11 are respectively installed in the zipper tapes 1 above the respective plug members 21 and 22, keeping the series of teeth 11 and the male plug member 21 at one zipper tape in match with the series of teeth 11 and the female plug member 22 at the other zipper tape, and then the movable bottom-end piece 3 is sleeved onto the front side (top end) of the series of teeth 11 at the zipper tape in which the female plug member 22 is installed, and then the movable bottom-end piece 3 is pulled downwards along the corresponding series of teeth 11 toward the female plug member 22 to force the locating groove 34 into engagement with the locating block 223 (see FIG. 7), and then the slide 5 is sleeved onto the front side (top end) of the series of teeth 11 at the zipper tape in which the female plug member 22 is installed, and then the slide 5 is pulled downwards and sleeved onto the female plug member 22 and stopped at the front side of the movable bottom-end piece 3, and then the male plug member 21 at the other zipper tape 1 is inserted through the slide 5 into the receiving chamber 31 of the movable bottom-end piece 3. After the male plug member 21 has been inserted through the slide 5 into the receiving chamber 31 of the movable bottom-end piece 3 and stopped at the vertical stop wall 32, the slide 5 can then be pulled upwards to interlock the series of teeth 11 of the zipper tapes 1 and to close the invisible zipper (see FIG. 5).

A plurality of locating blocks 223 can be disposed at a peripheral wall of the male plug member 21.

Figure 12:
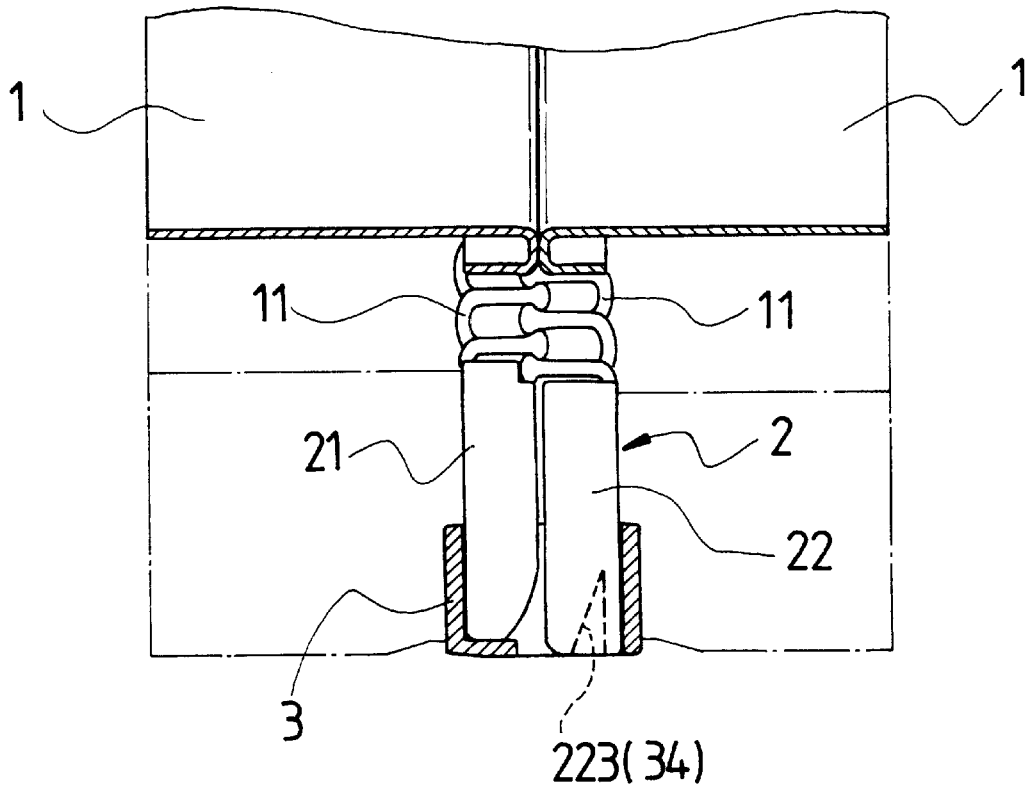
FIG. 12 is a sectional view of a part of the present invention, showing the bottom open-end type invisible zipper closed.
Figure 13:
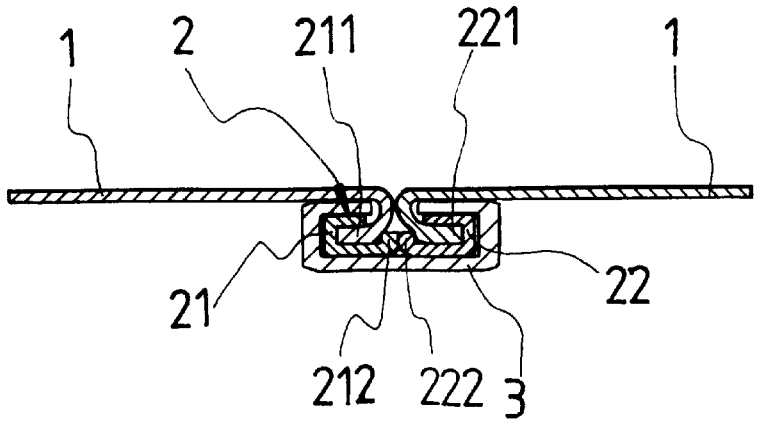
FIG. 13 is a front view in section of the present invention, showing the bottom open-end type invisible zipper closed.
Figure 14:
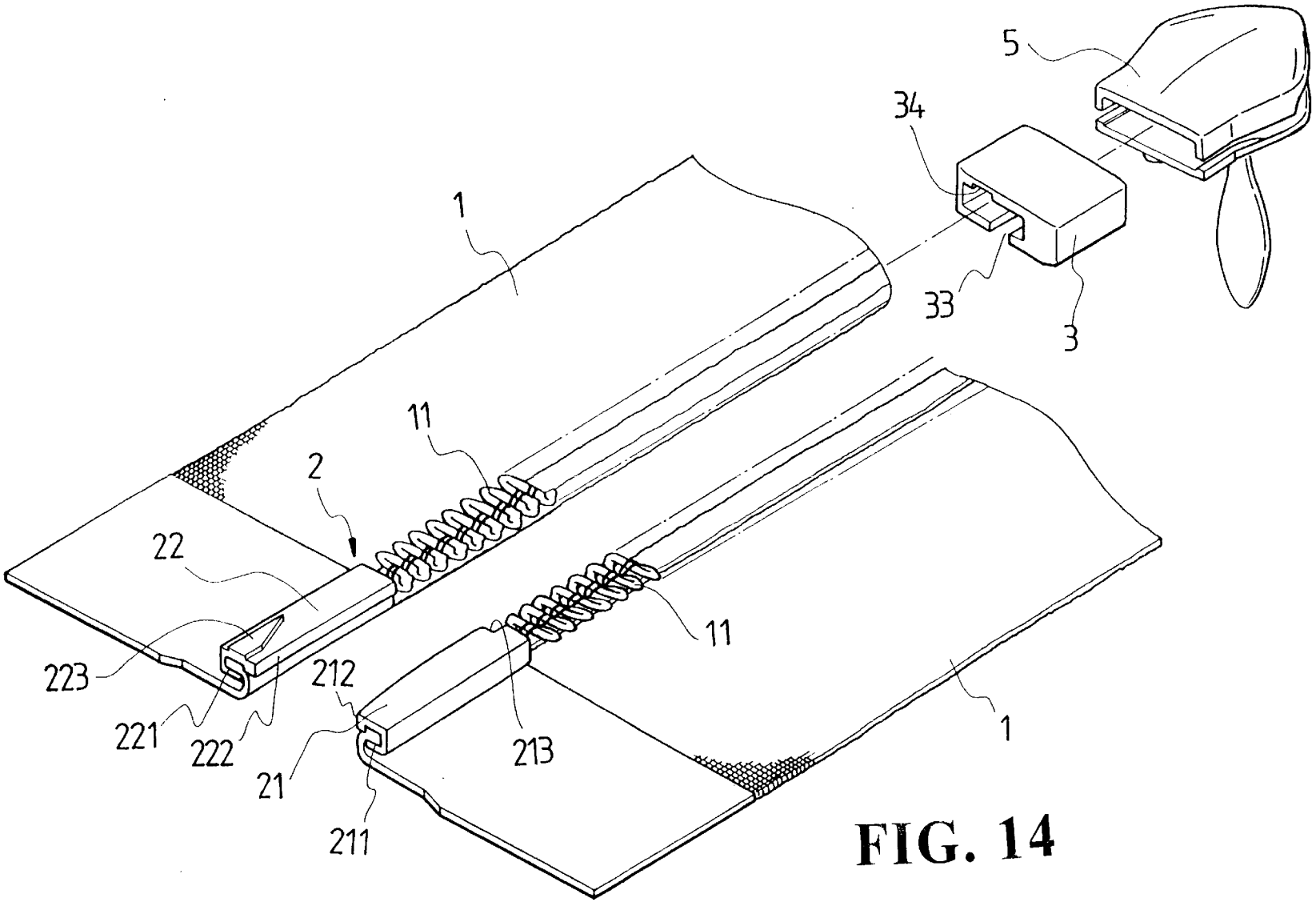
FIG. 14 is an exploded view of an alternate form of the present invention, showing a wedge-like stop block formed on the top sidewall of the female plug member.
Figure 15:
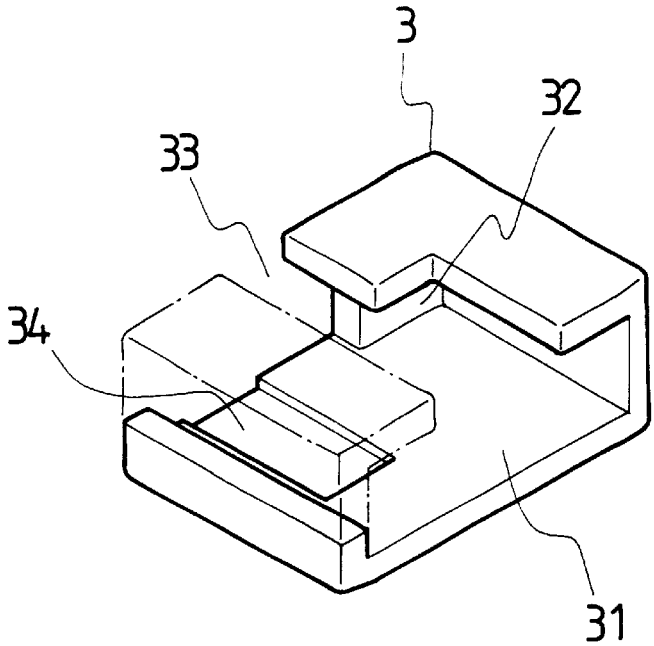
FIG. 15 is a perspective view showing an alternate form of the movable bottom-end piece according to the present invention.
Figure 16:
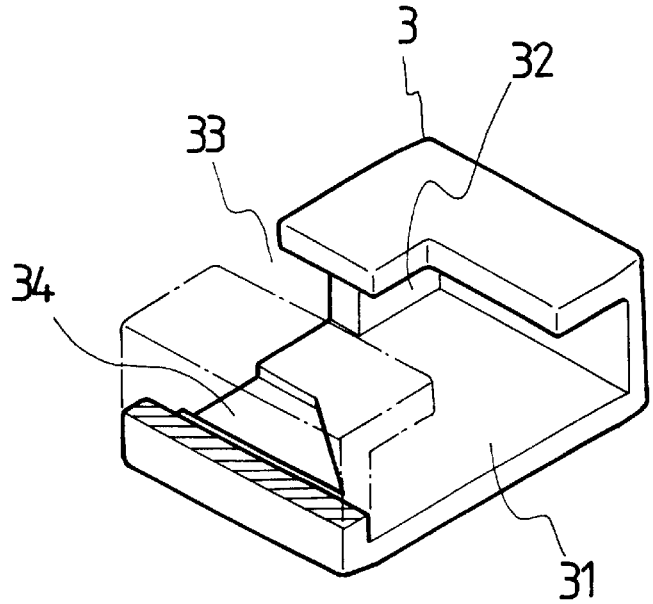
FIG. 16 is a perspective view showing another alternate form of the movable bottom-end piece according to the present invention.

When closing the invisible zipper, the male plug member 21 is inserted through the slide 5 into the receiving chamber 31 of the movable bottom-end piece 3 and abutted against the female plug member 22 at one side, and then the slide 5 is pulled upwards to interlock the series of teeth 11 at the two zipper tapes 1, keeping the male and female plug members 21 and 22 positioned in the movable bottom-end piece 3 (see FIG. 12).

As indicated above, the movable bottom-end piece 3 can be moved along the series of teeth 11 at the zipper tape 1 in which the female plug member 22 is installed. During stitching after opening of the invisible zipper, the user can move the movable bottom-end piece 3 away from the stitching area, enabling the zipper tapes 1 to be conveniently fastened to the garment, bag, or the like. After installation, the movable bottom-end piece 3 is prohibited from falling out of the invisible zipper.

Figure 17:
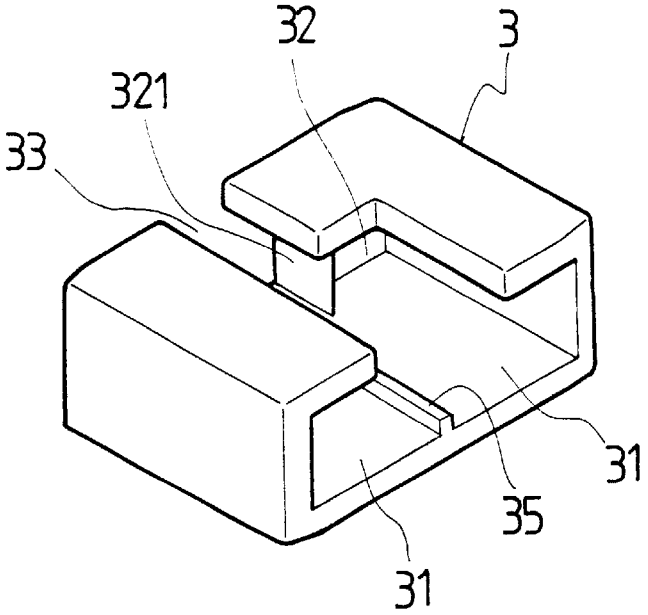
FIG. 17 is a perspective view showing still another alternate form of the movable bottom-end piece according to the present invention.
Figure 18:
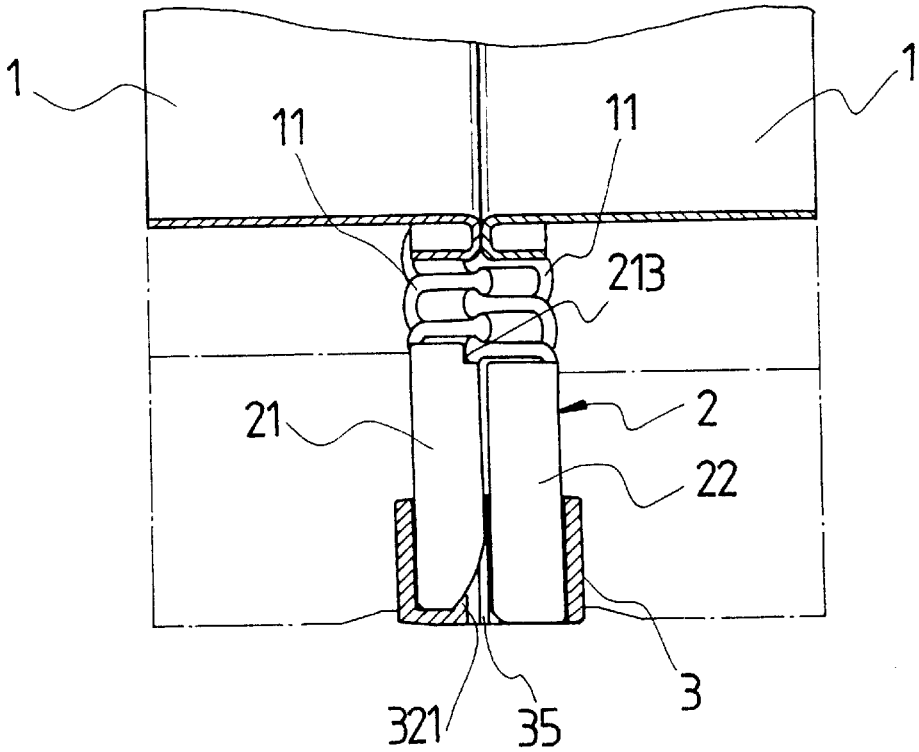
FIG. 18 is a sectional view showing the movable bottom-end piece of FIG. 17 installed in the bottom open-end type invisible zipper.
Figure 19:
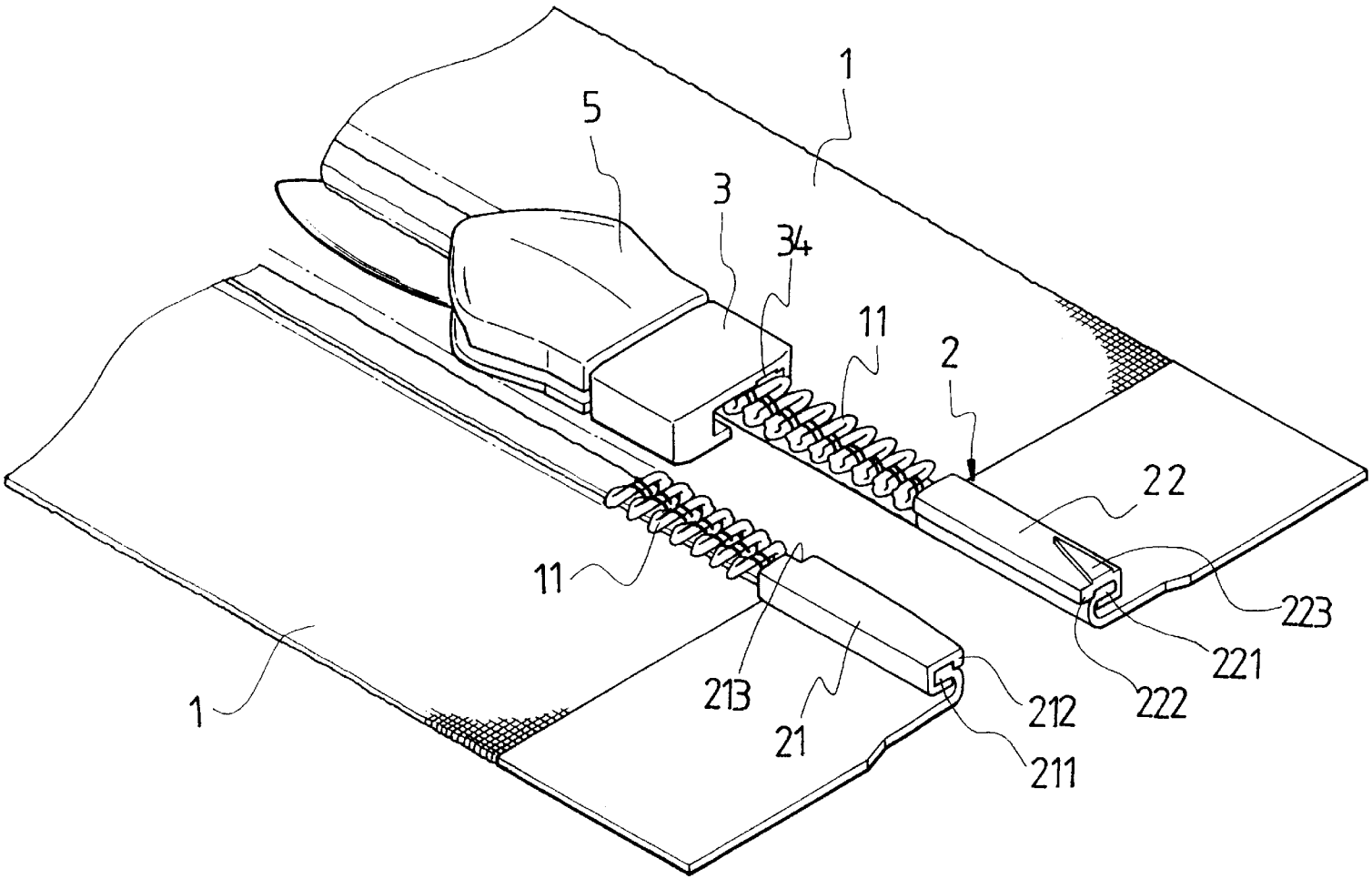
FIG. 19 is a perspective view of the present invention, showing the plug member set and the movable bottom-end piece designed for a right-handed user.
Figure 20:
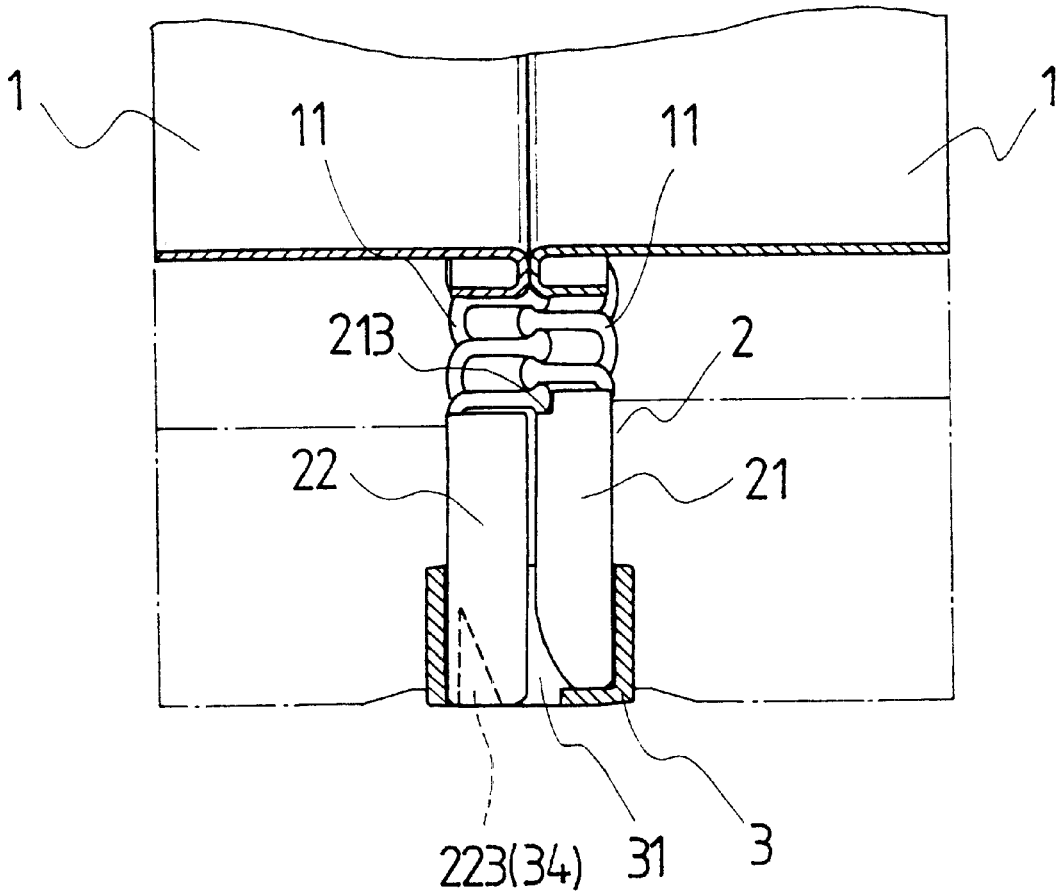
FIG. 20 is a top view in section of the present invention, showing the plug member set and the movable bottom-end piece designed for a right-handed user.
Figure 21:
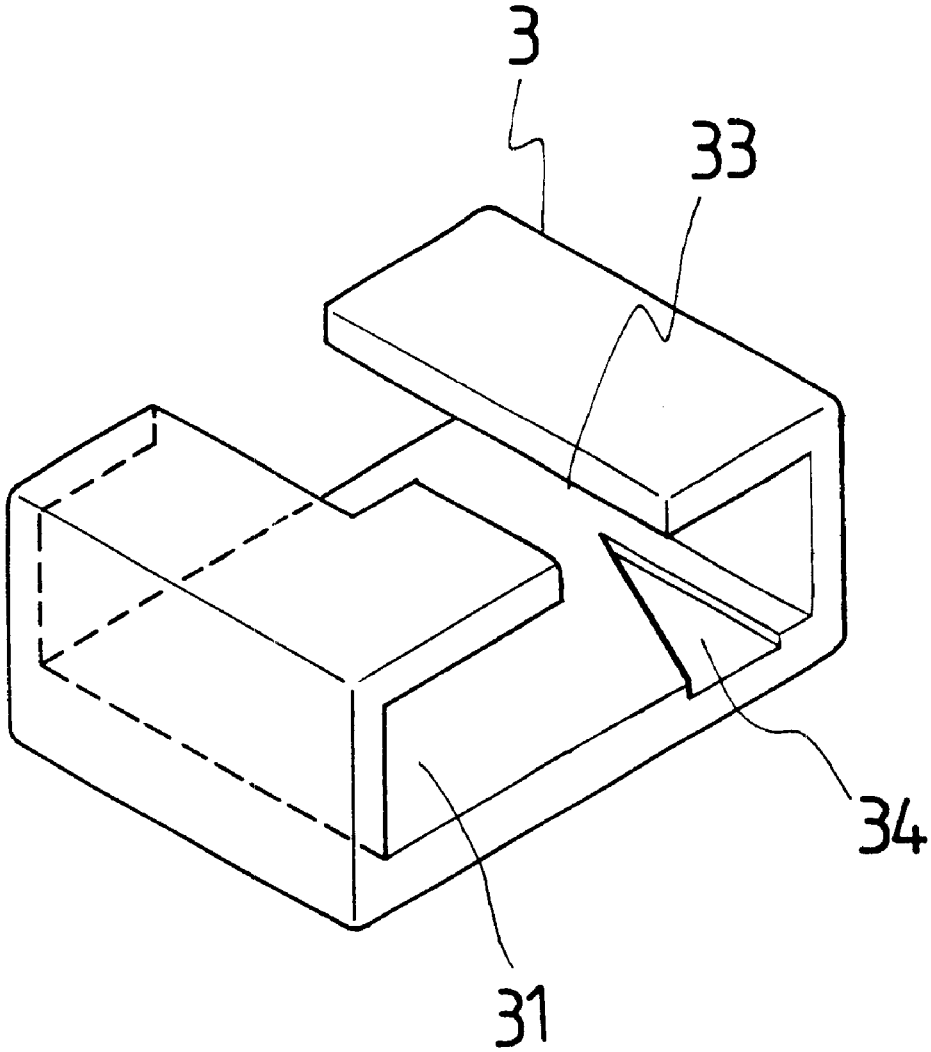
FIG. 21 is a perspective view of still another alternate form of the movable bottom-end piece according to the present invention.

Referring to FIGS. 17 and 18, the movable bottom-end piece 3 can be made having a longitudinal rib 35 and a stop flange 321. The longitudinal rib 35 is disposed on the inside of the bottom wall to separate the receiving chamber 31 into two halves to facilitate positioning of the plug members 21 and 22. The stop flange 321 is inwardly extended from the vertical rear stop wall 32 at right angles, and adapted to hold the male plug member 21 in place. The movable bottom-end piece 3 and the plug member set 2 can be designed to fit a left-handed user (see FIGS. 6 and 7) or a right-handed user (see FIGS. 19 and 20). Further, the receiving chamber 31 can be double open-end open chamber extended through the front and rear sides (see FIG. 21).

Figure 22:
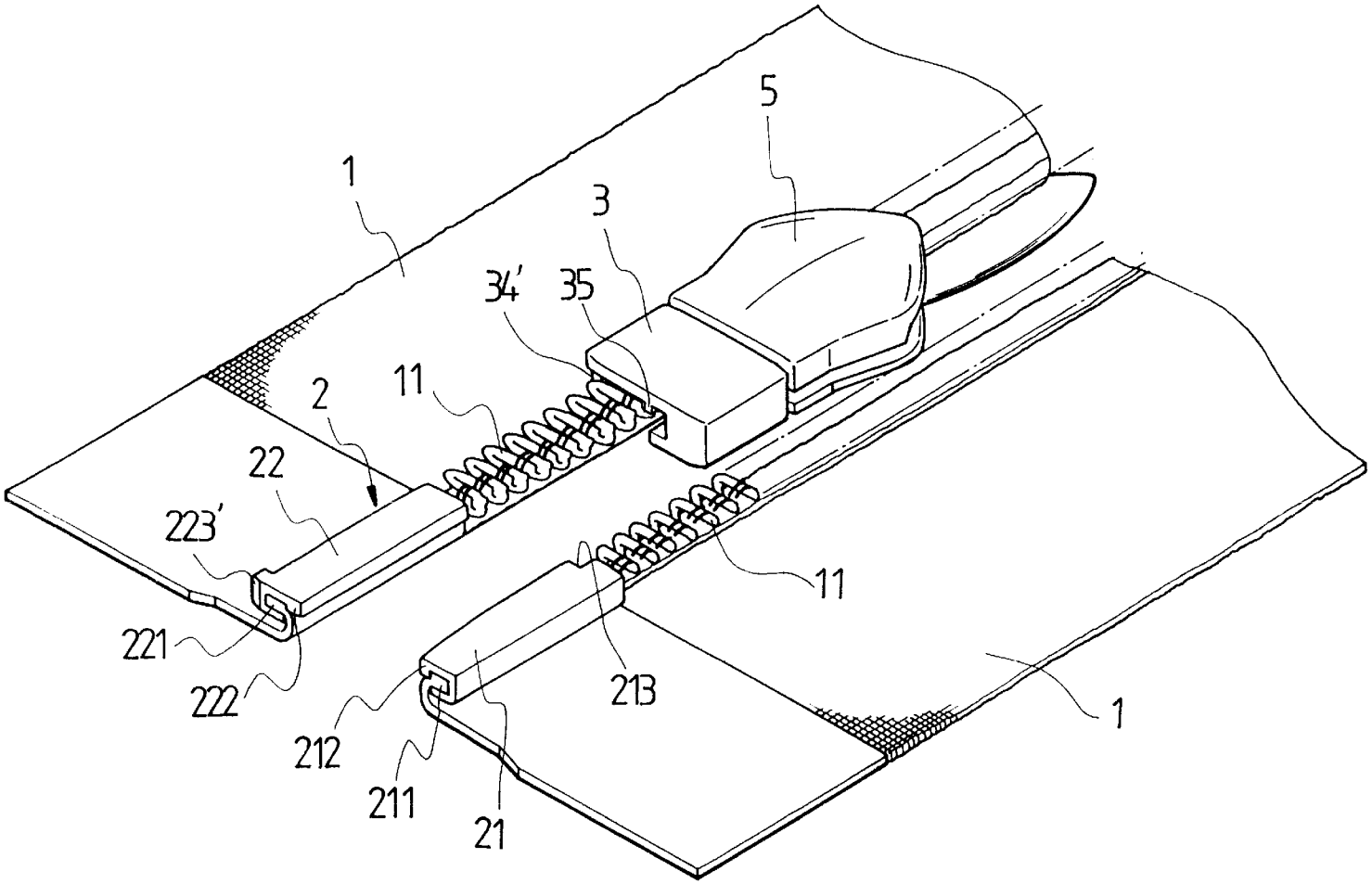
FIG. 22 is a perspective view showing an alternate form of the escape-preventive structure according to the present invention.
Figure 23:
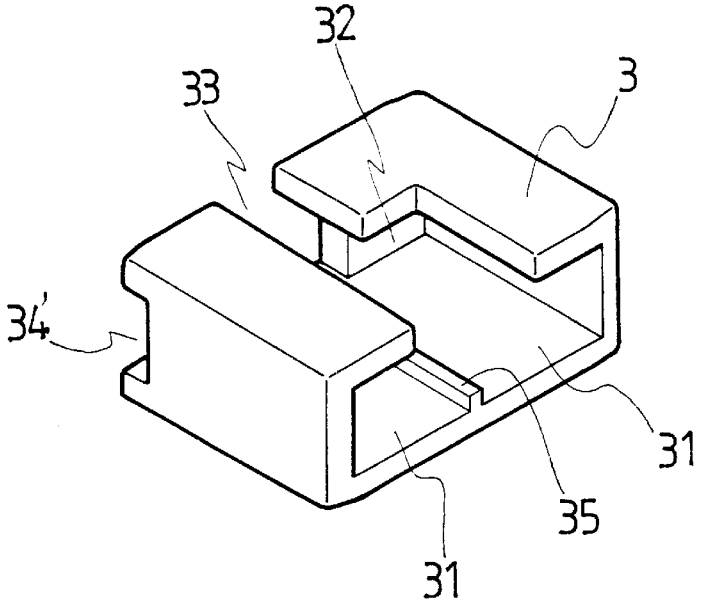
FIG. 23 is a perspective view of still another alternate form of the movable bottom-end piece according to the present invention.

FIGS. 22 and 23 show an alternate form of the escape-preventive structure. According to this alternate form, the escape-preventive structure comprises a protruding end block 223' extended sideways from the bottom side of the female plug member 22, and an end notch 34' disposed at the rear side of the movable bottom-end piece 3 corresponding to the protruding end block 223'. When pulling the movable bottom-end piece 3 downwards, the end notch 34' is forced into engagement with the protruding end block 223', and therefore the movable bottom-end piece 3 is stopped in the bottom limit position on the invisible zipper.

Figure 24:
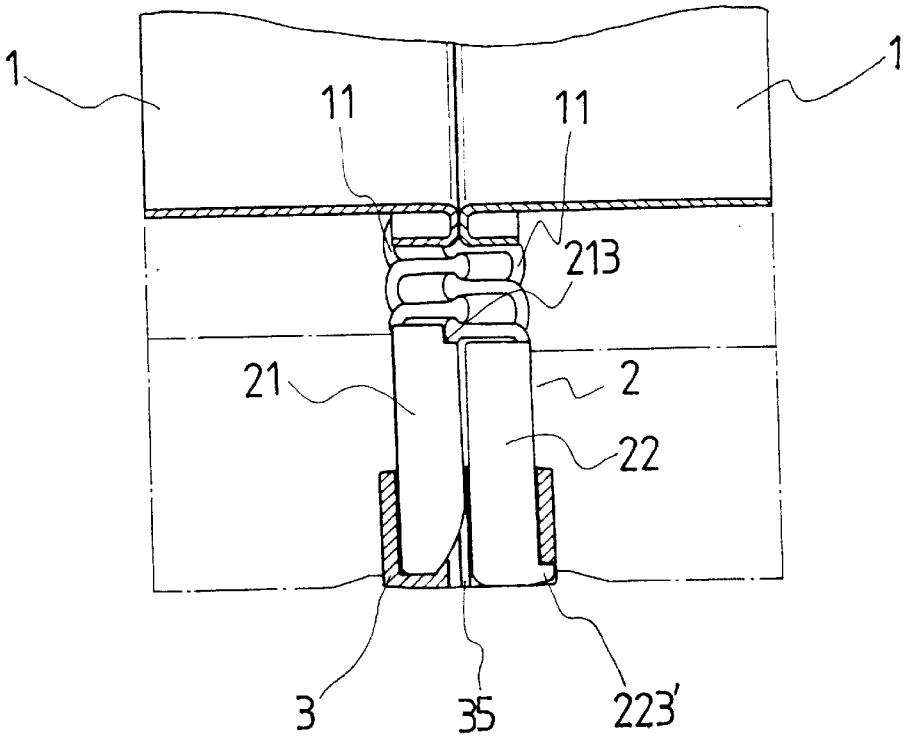
FIG. 24 is a sectional assembly view of FIG. 22.
Figure 25:
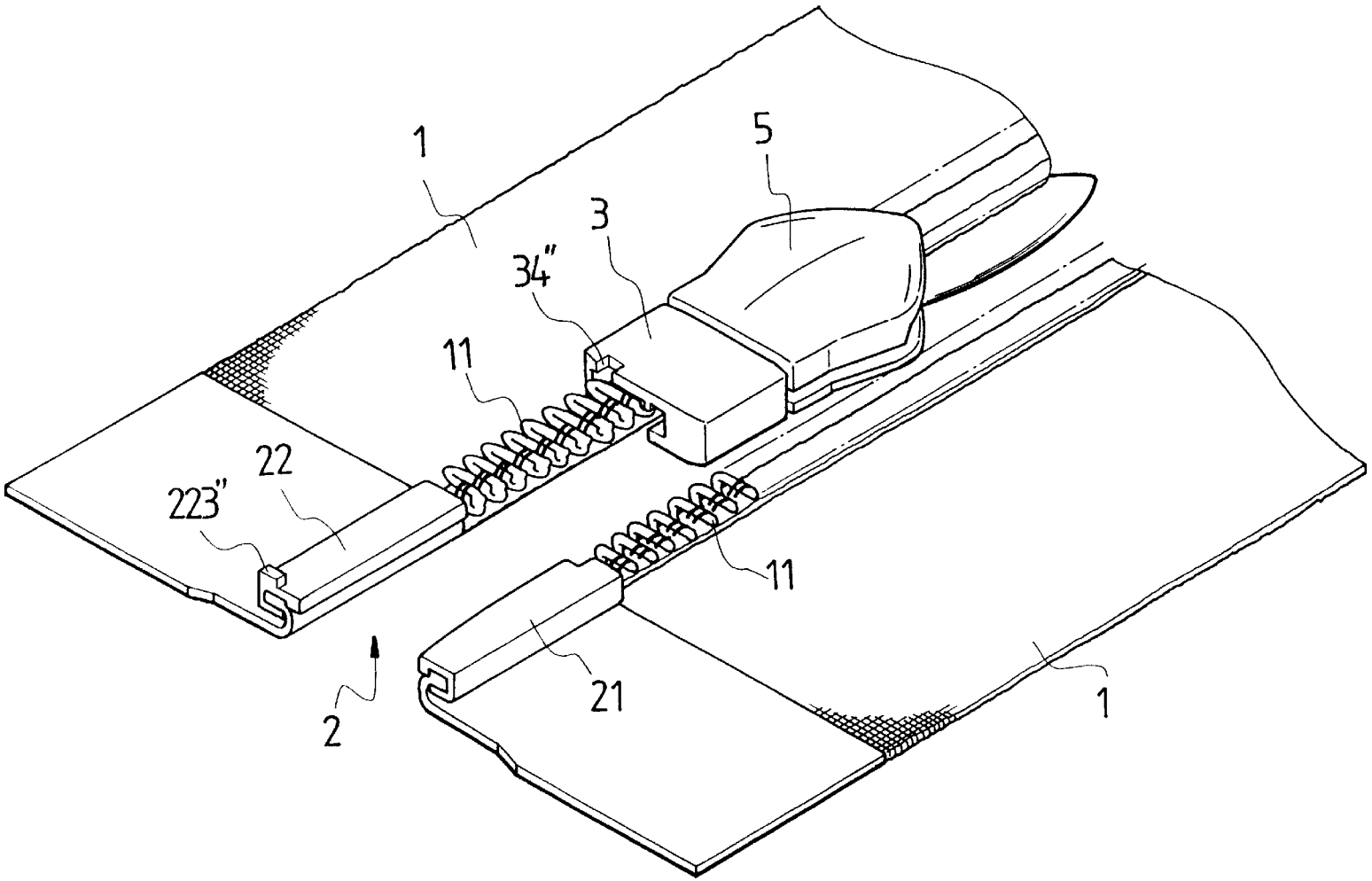
FIG. 25 is a perspective view showing another alternate form of the escape-preventive structure according to the present invention.
Figure 26:
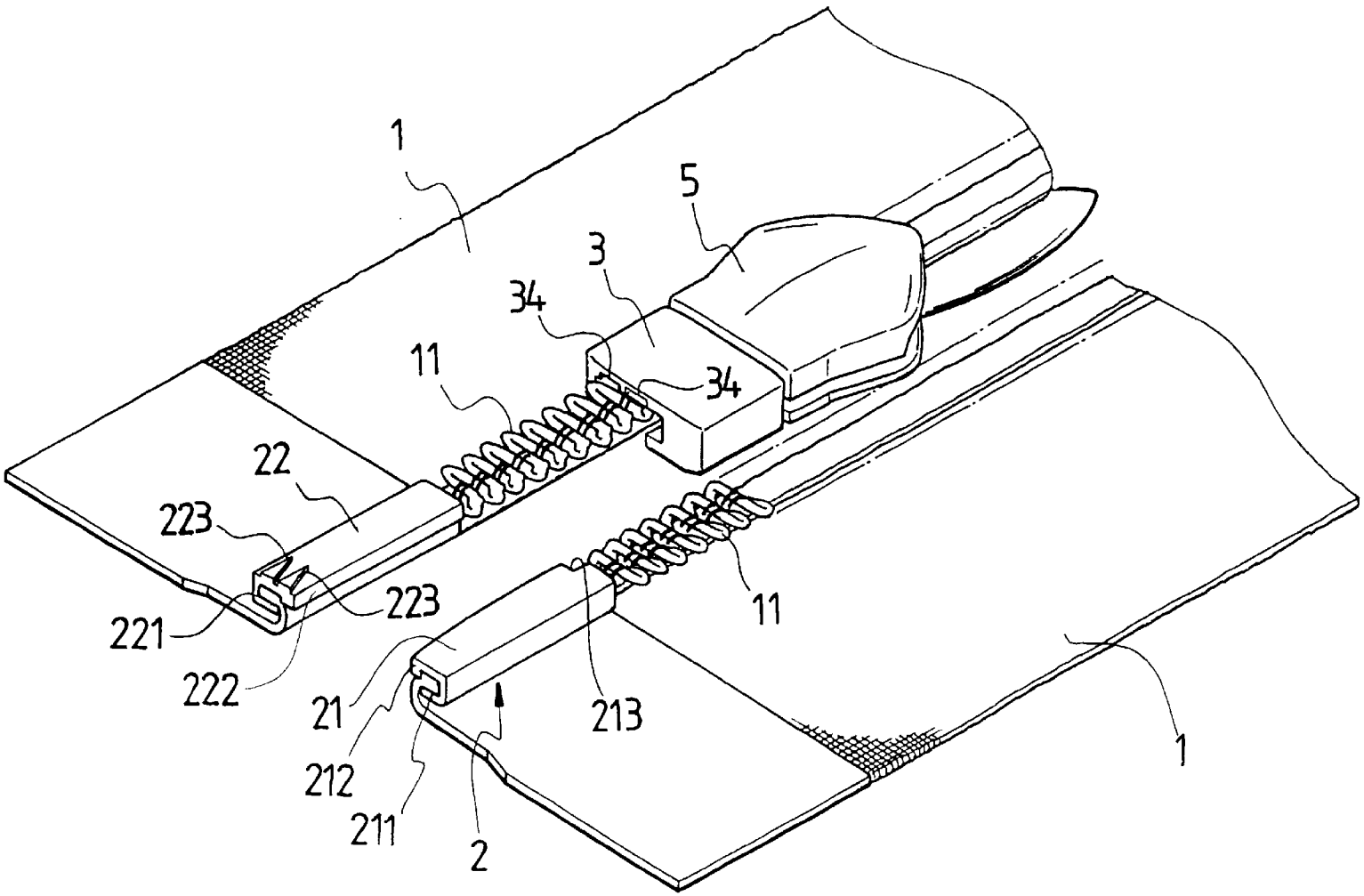
FIG. 26 is a view similar to FIG. 7 showing an alternative embodiment.

FIGS. 24 and 25 show another alternate form of the escape-preventive structure. According to this alternate form, the escape-preventive structure comprises a protruding end block 223" formed integral with the rear end of the top sidewall of the female plug member 22, and an end notch 34" formed on the rear side of the movable bottom-end piece 3. When pulling the movable bottom-end piece 3 downwards, the end notch 34" is forced into engagement with the protruding end block 223", and therefore the movable bottom-end piece 3 is stopped in the bottom limit position on the invisible zipper.

It is to be understood that the drawings are designed for purposes of illustration only, and are not intended for use as a definition of the limits and scope of the invention disclosed.

What the invention claimed is:

1. A bottom open-type invisible zipper comprising:

a first zipper tape and a second zipper tape, said first zipper tape and said second zipper tape comprising a respective series of teeth longitudinally disposed at an inner side thereof and adapted for interlocking therebetween;

a first plug member and a second plug member fixedly fastened respectively to said first zipper tape and said second zipper tape and each of the plug members connected to one of the ends of the series of teeth of the respective zipper tapes;

a movable bottom-end piece slidably coupled to said first zipper tape, said movable bottom-end piece comprising a one-piece construction having a receiving chamber adapted for receiving said first plug member and said second plug member, said receiving chamber having a bottom open side for receiving said second plug member, said receiving chamber comprising a stop wall adapted to prevent said second plug member from sliding out of said receiving chamber;

a slide slidably attached to the teeth of the first zipper tape;

said first plug member comprises at least one protruding end block;

said movable bottom-end piece comprises at least one locating groove corresponding to the at least one protruding end block of said first plug member; and said at least one protruding end block and said at least one locating groove upon engagement therebetween forms an escape-preventive structure which enables said movable bottom-end piece to be sleeved at the receiving chamber thereof onto said second zipper tape, and the at least one protruding end block of said first plug member into engagement with the at least one locating groove of said movable bottom-end piece to prevent said movable bottom-end piece from sliding out of the first plug member.

2. The bottom open-end type invisible zipper of claim 1, wherein the at least one protruding end block of said first plug member is respectively formed in an outer sidewall thereof, the at least one locating groove of said movable bottom-end piece is respectively disposed in an inner wall thereof.

3. The bottom open-end type invisible zipper of claim 1, wherein said at least one protruding end block of said first plug member comprises a shape selected from the group consisting of a triangular shape, a wedge shape and a trapezoidal shape: said at least one locating groove of said movable bottom-end piece comprises a shape selected from the group consisting of a triangular shape, a wedge shape and a trapezoidal shape, that corresponds to the at least one protruding end block of said first plug member.

4. The bottom open-end type invisible zipper of claim 1, wherein the at least one protruding end block of said first plug member disposed at an outer side of a bottom end of said first plug member; the end notch of said movable bottom-end piece is positioned at a rear end of an outer side thereof corresponding to the protruding end block of said first plug member.

* * * * *